US005365826A

United States Patent [19]

Wedertz

[11] Patent Number: 5,365,826

[45] Date of Patent: Nov. 22, 1994

[54] ROTARY GUN BREECH

[75] Inventor: Larry D. Wedertz, Alta Loma, Calif.

[73] Assignee: Hughes Missile Systems Company, Los Angeles, Calif.

[21] Appl. No.: 6,281

[22] Filed: Jan. 19, 1993

[51] Int. Cl.[5] ..... F41A 9/45

[52] U.S. Cl. ..... 89/46; 89/33.03

[58] Field of Search ..... 89/33.03, 46, 45, 33.05, 89/47; 42/27

[56] References Cited

U.S. PATENT DOCUMENTS

| | | | |
|---|---|---|---|
| 2,905,056 | 9/1959 | Nectoux | 89/45 |
| 3,598,016 | 8/1971 | Chiabrandy et al. | 89/47 |
| 3,763,741 | 10/1973 | Rieke | 89/47 |
| 4,338,852 | 7/1982 | Jarvis | 89/33.03 |
| 4,442,753 | 4/1984 | Pouri et al. | 89/46 |
| 4,454,799 | 6/1984 | Gilvydis | 89/47 |
| 4,494,441 | 1/1985 | Magnuson | 89/46 |
| 4,669,357 | 6/1987 | von Laar et al. | 89/45 |
| 4,996,903 | 3/1991 | Arakaki | 89/8 |
| 5,168,121 | 12/1992 | Maynard | 89/45 |

FOREIGN PATENT DOCUMENTS

| | | | |
|---|---|---|---|
| 706222 | 5/1941 | Germany | 89/33.05 |
| 2543155 | 3/1977 | Germany | 89/45 |

*Primary Examiner*—Stephen M. Johnson

*Attorney, Agent, or Firm*—Charles D. Brown; Randall M. Heald; Wanda K. Denson-Low

[57] ABSTRACT

A rotary breech mechanism (10) is provided for loading large caliber guns. The mechanism comprises a rotary transfer member (12) which is cylindrical and mounted in the gun barrel (16) near the breech end (18). A hole (14) through the rotary transfer member (12) is aligned either with an ammunition magazine tube (48) for loading or with the gun barrel (16) for firing of a projectile (20). Once the projectile (20) has been fired, the rotary transfer member (12) is rotated to accept the next projectile, no matter what position the gun is in. The azimuthal orientation of the barrel (16) does not affect the operation of the loading mechanism.

6 Claims, 1 Drawing Sheet

ROTARY GUN BREECH

BACKGROUND OF THE INVENTION

1. Field of the Invention

This invention relates to large-caliber gun breeches and, more particularly, to a rotatable gun breech capable of being aligned alternately with the ammunition magazine and gun barrel for various gun elevations and axes.

2. Description of the Related Art

Two examples of cartridge feeding and loading devices for light weapons utilizing a mechanism having a rotating member are described briefly below.

Hill U.S. Pat. No. 2,624,241 relates to that portion of a gun action mechanism which transfers cartridges from the magazine to the gun barrel. A transfer mechanism is provided which comprises a rotatable disk constructed to receive the cartridges singly in a slot or trough formed on one of its faces, and to rotate them through a 90 degree angle in alignment with the barrel bore so that they are successively inserted into the firing chamber with each actuation of a bolt.

Rieke U.S. Pat. No. 3,763,741 is directed to a cartridge feeding and loading device in which cartridges withdrawn from a cartridge belt are adapted to be moved by means of a stepwise driven follower in a stationary longitudinally extending conveyor passage. The cartridges are transferrable by means of an intermittently movable pusher from the conveyor passage into a corresponding bore of a rotatable disk. The disk is rotatable into an angular position which corresponds to the elevational position of the weapon and thereby of the weapon magazine. The pusher transfers the cartridge from the transfer disk into the magazine.

Neither of the patents briefly described above discloses a breech-loading device for a gun that transfers projectiles from the magazine to elevated positions of the weapon barrel by means of a rotatable cylinder with a through hole in the center thereof that allows the cylinder to be completely closed at the rear when aligned with the gun barrel without providing additional sliding hardware such as sleeves or end caps.

SUMMARY OF THE INVENTION

A rotary breech mechanism is provided for loading large-caliber guns of the future such as electromagnetic rail guns and liquid-propellant guns. The use of ammunition carriers, transfer trays, empty case trays, and ejectors associated with present gun designs are obviated by the present invention. A rotary transfer member is provided which is cylindrical in shape with a hole through the curved section and bearings on the flat portion. The rotary motion required for alignment of the projectile with the barrel is accomplished by a gearing arrangement using an actuator. The rotary transfer member must be centered about the pivot point of the gun barrel. In a first, loading position the hole through the rotary transfer member is aligned with an ammunition magazine tube. The projectile is elevated by a telescoping ram into the transfer member and the transfer member is then rotated so that the projectile is aligned with the gun barrel in a second, closed-chamber position. Once the projectile is fired, the rotary transfer member is rotated to accept the next projectile, no matter what position the gun is in. The proper amount of rotation is determined by a mechanism that senses the angle of elevation of the gun barrel. The azimuthal orientation of the gun barrel does not affect the operation of the loading mechanism because the hole through the rotary transfer member in its first position is aligned with the azimuthal axis of rotation, which coincides with the longitudinal axis of the ammunition magazine tube. Alternative means for rotating the rotary transfer member include compressed gas actuation or a hydraulic drive arrangement.

BRIEF DESCRIPTION OF THE DRAWINGS

A better understanding of the present invention may be realized from a consideration of the following detailed description, taken in conjunction with the accompanying drawing in which.

DESCRIPTION OF THE PREFERRED EMBODIMENT

Figure 1:
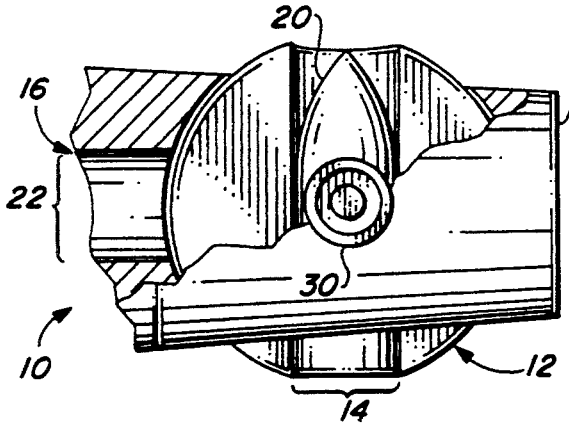
FIG. 1 is a schematic side elevation view, partly broken away, of a rotary gun breech mechanism in accordance with the present invention.

A rotary gun breech mechanism 10 in accordance with the present invention is shown in a elevation view, partly broken away, in FIG. 1. The rotary breech mechanism 10 comprises a rotary transfer member 12 having a cylindrical passage 14 through the center of the curved portion, rotatably mounted inside a gun barrel 16 near its breech end 18. Cylindrical passage 14 accommodates a projectile 20 which is loaded into it from below as shown in FIG. 1 and subsequently rotated so that it is aligned with the bore 22 of gun barrel 16. The amount of rotation necessary to align cylindrical passage 14 with bore 22 of gun barrel 16 depends on the angle of elevation of gun barrel 16. After projectile 20 is fired through barrel 16, rotary transfer member 12 must be rotated so that cylindrical passage 14 is once again aligned with an ammunition magazine tube through which another projectile is loaded into passage 14.

Rotary transfer member 12 comprises a generally cylindrical rotatable part whose flat faces 23 and 24 have bearings 26 and 28 mounted in them. A trunnion 30 mounted on barrel 16 has internal shafts 32 and 34 which are journalled in bearings 26 and 28. Around the outer circumference of transfer member 12 are gear teeth 36 for rotating the rotary transfer member 12. An alternative drive arrangement comprises a drive gear 38 driven by of actuator 40. As shown in the end view of FIG. 2, actuator 40 rotates transfer member 12 about a horizontal axis through shafts 32 and 34. If the axis of azimuthal rotation of gun barrel 16 coincides with the central axis of the ammunition magazine tube, the angle through which transfer member 12 must be rotated in going from a loading orientation to a firing orientation is independent of azimuth.

Figure 3:
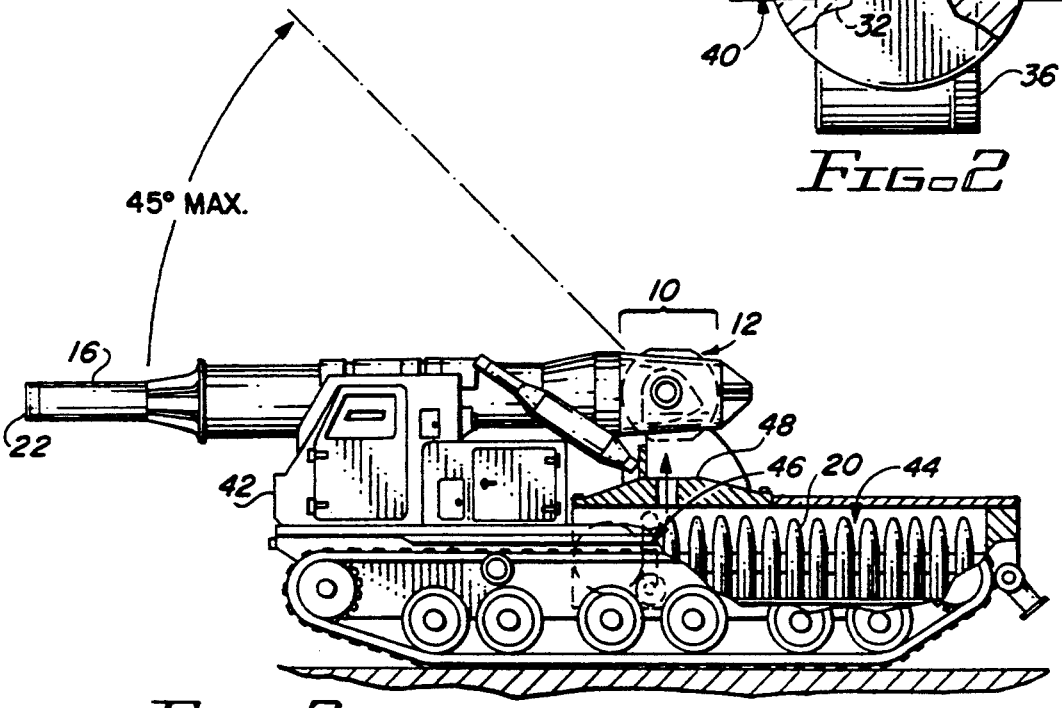
FIG. 3 is a schematic side elevational view of a gun system using the rotary breech mechanism.

FIG. 3 is a side view, partly in section and partly broken away, showing a transport vehicle 42 for a gun having a barrel 16 and a rotary breech mechanism 10 in accordance with the present invention. Ammunition magazine 44 contains a linear array of projectiles 20 which are successively loaded into rotary transfer member 12, rotated into alignment with bore 22 of barrel 16, and fired. A telescoping ram 46 lifts each projectile 20 through ammunition magazine tube 48 when transfer member 12 has its central passage 14 aligned with magazine tube 48. Projectile 20 is further lifted into passage 14, rotated through the angle necessary to produce alignment of passage 14 with bore 22, and then fired through barrel 16.

The angle of rotation necessary to change the orientation of transfer member 12 from its firing position to its loading position is equal to the complement of the angle of elevation of the barrel 16. Since the maximum angle of elevation is 45 degrees, as is well known from the physical laws governing projectile motion, the amount of rotation needed to change transfer member 12 from a firing to a loading position will be somewhere between 45 and 90 degrees.

As an alternative to the linear ammunition feed arrangement shown in FIG. 3, a turntable arrangement with projectiles arranged in a circular pattern could be used. The only requirement is that successive projectiles be positionable beneath ammunition magazine tube 48 and rotary transfer member 12 for loading. The diameter of projectiles 20 such as are illustrated in FIG. 3 will typically be from 105 to 155 millimeters, that is, about 5 to 6 inches.

Figure 4:
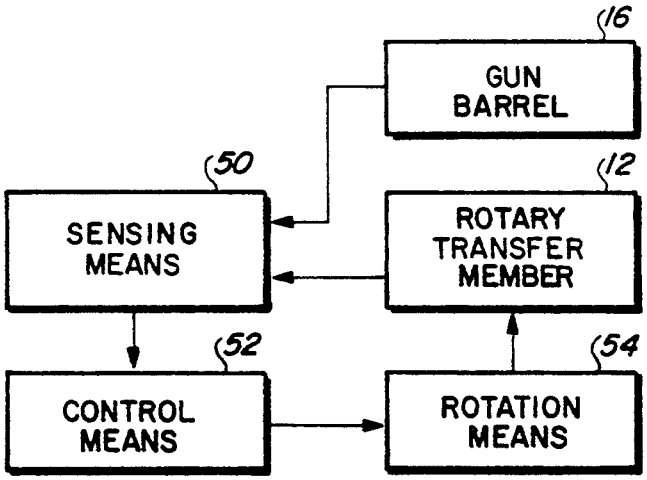
FIG. 4 is a schematic block diagram of an arrangement for controlling the orientations of the rotary transfer member relative to the gun barrel.

FIG. 4 is a schematic block diagram of an arrangement for controlling the orientation of the rotary transfer member 12 relative to the bore 22 of gun barrel 16. Sensing means 50 determines the angular orientation of transfer member 12 with respect to barrel 16. There are a number of conventional methods of determining the relative alignment of two bodies employing mechanical and/or electromechanical devices. Information about the relative orientation of rotary transfer member 12 with respect to bore 22 of gun barrel 16 is transmitted to control means 52 which is operatively connected to rotation means 54. In addition to making use of the information from sensing means 50 concerning relative alignment of gun barrel 16 and transfer member 12, control means 52 must also keep track of whether the required operation of rotation means 54 corresponds to preparation for loading or firing. In the former case, transfer member 12 is already aligned with bore 22 and must be rotated to a vertical orientation for loading. In the latter case, the information from sensing means 50 tells control means 52 how long rotation means 54 must be operated in order to achieve alignment of transfer member 12 with bore 22. In order to prevent overshoot, some sort of feedback arrangement with critical damping could be employed.

Figure 2:
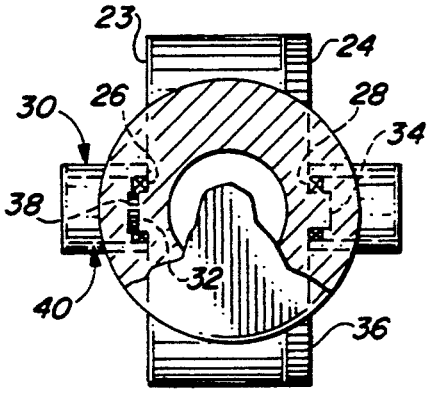
FIG. 2 is a schematic end elevational view, partly broken away, of the rotary gun breech mechanism.

Rotation means 54 can take the form of an electrical motor connected to rotary transfer member 12 through the gearing arrangement shown in FIG. 2. Alternatively, rotation means 54 can be powered hydraulically or by compressed gas. For example, a piston and cylinder arrangement with either a hydraulic fluid or compressed gas as the working substance can be used to drive a gear rack engaged with gear teeth 24 on rotary transfer member 12 to effect rotation.

Although there have been shown and described hereinabove specific arrangements of a rotary gun breach for a large-caliber gun in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the annexed claims.

What is claimed is:

1. A loading mechanism for a large-caliber gun having a barrel with a bore and a breech and supported on trunnions in first bearings on opposite sides of the barrel, comprising:

a rotary transfer member rotatably mounted inside said barrel near said breech, having a central passage therethrough to allow loading of said transfer member with a projectile when said transfer member is in a first orientation aligned with the orientation of the projectile and to accommodate said projectile for firing when said transfer member is rotated to a second angular orientation with said passage aligned with said bore;

pivotable support means installed within the gun barrel trunnions for supporting the transfer member, said support means comprising a pair of opposing shafts at opposite ends of said rotary transfer member extending into axial bores of respective ones of said trunnions on opposite sides of the gun barrel;

second bearings within the trunnion bores rotatably supporting said shafts therein; and an actuator installed in one of said trunnions for driving one of said shafts to control the rotation of the transfer member.

2. The loading mechanism of claim 1 further comprising orientation means for orienting said transfer member with respect to said barrel.

3. The loading mechanism of claim 2 wherein said orientation means comprises:

sensing means for sensing an angular orientation of said transfer member with respect to said barrel;

rotation means for rotating said transfer member from said first to said second angular orientation and vice versa; and control means for operating said rotation means in response to a signal from said sensing means.

4. The loading mechanism of claim 1 wherein said transfer member comprises a generally cylindrical rotatable part with said central passage being cylindrical and of the same diameter as said bore, said rotary transfer member being coupled to said barrel by said pivotable support means, one of said pair of opposing shafts having gear teeth drivingly engaged with said actuator for controlling said transfer member rotation.

5. The loading mechanism of claim 1 wherein said gun comprises and electromagnetic rail gun.

6. The loading mechanism of claim 1 wherein said gun comprises a liquid-propellant gun.

* * * * *